US010356515B2

(12) United States Patent
Defraene et al.

(10) Patent No.: US 10,356,515 B2
(45) Date of Patent: Jul. 16, 2019

(54) SIGNAL PROCESSOR

(71) Applicant: NXP B.V., Eindhoven (NL)

(72) Inventors: Bruno Gabriel Paul G. Defraene, Blanden (BE); Cyril Guillaumé, St Josse-Ten-Noode (BE); Wouter Joos Tirry, Wijgmaal (BE)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 15/980,942

(22) Filed: May 16, 2018

(65) Prior Publication Data

US 2018/0359560 A1 Dec. 13, 2018

(30) Foreign Application Priority Data

Jun. 13, 2017 (EP) ..... 17175847

(51) Int. Cl.
*H04R 1/40* (2006.01)
*G10K 11/178* (2006.01)
(Continued)

(52) U.S. Cl.
CPC ..... *H04R 1/406* (2013.01); *G10K 11/17854* (2018.01); *G10L 21/0208* (2013.01);
(Continued)

(58) Field of Classification Search
None
See application file for complete search history.

(56) References Cited

U.S. PATENT DOCUMENTS 7,242,781 B2 7/2007 Hou
7,970,123 B2 6/2011 Beacoup
(Continued)

FOREIGN PATENT DOCUMENTS

EP 1 116961 A2 7/2001
EP 2 876 900 A1 5/2015
(Continued)

OTHER PUBLICATIONS

Ewalt, Heather E. et al; "Combining Multisource Wiener Filtering with Parallel Beamformers to Reduce Noise from Interfering Talkers"; Proceedings ICSP'04, vol. 1; pp. 445-458 (2004).
(Continued)

*Primary Examiner* — Curtis A Kuntz
*Assistant Examiner* — Kenny H Truong

(57) ABSTRACT

A signal processor comprising a plurality of microphone-terminals configured to receive a respective plurality of microphone-signals. A plurality of beamforming-modules, each respective beamforming-module configured to receive and process input-signalling representative of some or all of the plurality of microphone-signals to provide a respective speech-reference-signal, a respective noise-reference-signal, and a beamformer output signal based on focusing a beam into a respective angular direction. A beam-selection-module comprising a plurality of speech-leakage-estimation-modules, each respective speech-leakage-estimation-module configured to receive the speech-reference-signal and the noise-reference-signal from a respective one of the plurality of beamforming-modules; and provide a respective speech-leakage-estimation-signal based on a similarity measure of the received speech-reference-signal with respect to the received noise-reference-signal. The beam-selection-module further comprises a beam-selection-controller configured to provide a control-signal based on the speech-leakage-estimation-signals.

15 Claims, 5 Drawing Sheets

(51) Int. Cl.

| | |
|---|---|
| ***H04R 3/00*** | (2006.01) |
| ***H04R 5/027*** | (2006.01) |
| ***G10L 21/0208*** | (2013.01) |
| ***G10L 21/0216*** | (2013.01) |
| ***G10L 25/84*** | (2013.01) |

(52) U.S. Cl.

CPC ..... *H04R 3/005* (2013.01); *H04R 5/027* (2013.01); *G10K 2210/1082* (2013.01); *G10L 25/84* (2013.01); *G10L 2021/02166* (2013.01); *H04R 2201/403* (2013.01); *H04R 2430/23* (2013.01)

(56) References Cited

U.S. PATENT DOCUMENTS

| | | | | |
|---|---|---|---|---|
| 2012/0330652 | A1 | 12/2012 | Turnbull et al. | |
| 2015/0172807 | A1* | 6/2015 | Olsson ..... | G10K 11/175 381/74 |

FOREIGN PATENT DOCUMENTS

| | | | |
|---|---|---|---|
| WO | WO-03/073786 | A1 | 9/2003 |
| WO | WO-2005/006808 | A1 | 1/2005 |

OTHER PUBLICATIONS

Wang, Lin et al; "Noise Power Spectral Density Estimation Using MaxNSR Blocking Matrix"; IEEE/ACM Trans. ASLP, vol. 23, No. 9; (Sep. 2015).

* cited by examiner

SIGNAL PROCESSOR

CROSS-REFERENCE TO RELATED APPLICATIONS

This application claims the priority under 35 U.S.C. § 119 of European patent application no. 17175847.7, filed Jun. 13, 2017 the contents of which are incorporated by reference herein.

The present disclosure relates to signal processors and associated methods, and in particular, although not necessarily, to signal processors configured to process speech signals.

According to a first aspect of the present disclosure there is provided a signal processor comprising:

a plurality of microphone-terminals configured to receive a respective plurality of microphone-signals;

a plurality of beamforming-modules, each respective beamforming-module configured to:

receive and process input-signalling representative of some or all of the plurality of microphone-signals to provide a respective speech-reference-signal, a respective noise-reference-signal, and a beamformer output signal based on focusing a beam into a respective angular direction;

a beam-selection-module comprising a plurality of speech-leakage-estimation-modules, each respective speech-leakage-estimation-module configured to:

receive the speech-reference-signal and the noise-reference-signal from a respective one of the plurality of beamforming-modules; and provide a respective speech-leakage-estimation-signal based on a similarity measure of the received speech-reference-signal with respect to the received noise-reference-signal;

wherein the beam-selection-module further comprises a beam-selection-controller configured to provide a control-signal based on the speech-leakage-estimation-signals; and an output-module configured to:

receive: (i) a plurality of beamformer output signals from the beamforming modules; and (ii) the control-signal; and select one or more, or a combination, of the plurality of beamformer output signals as an output-signal, in accordance with the control-signal.

In one or more embodiments, each beamforming-module of the plurality of beamforming-modules may be configured to focus a beam into a fixed angular direction.

In one or more embodiments, each beamforming-module of the plurality of beamforming-modules may be configured to focus a beam into a different angular direction.

In one or more embodiments, each respective beamformer output signal may comprise a noise cancelled representation of one or more, or a combination, of the plurality of microphone-signals.

In one or more embodiments, each speech-leakage-estimation-signal may be representative of speech-leakage-estimation-power, and the beam-selection-module may be configured to: determine a selected-beamforming-module that is associated with the lowest speech-leakage-estimation-power; and provide a control-signal that is representative of the selected-beamforming-module, such that the output-module is configured to select the beamformer output signal associated with the selected-beamforming-module as the output-signal.

In one or more embodiments, the beam-selection-controller may be configured to: receive a speech activity control signal; if the speech activity control signal is representative of detected speech, then provide the control-signal based on most recently received speech-leakage-estimation-signals; and if the speech activity control signal is not representative of detected speech, then provide the control-signal based on previously received speech-leakage-estimation-signals.

In one or more embodiments, the signal processor may further comprise a plurality of frequency-filter blocks configured to receive signalling representative of the plurality of microphone-signals and to provide the input signalling in a plurality of different frequency bands, wherein the beam-selection-controller may be configured to provide the control-signal such that the output-module is configured to select at least two different beamformer output signals in different frequency bands.

In one or more embodiments, the signal processor may further comprise a frequency-selection-block configured to provide the speech-leakage-estimation-signal, by selecting one or more frequency bins representative of the some or all of the plurality of microphone-signals, the selection based on one or more speech features, wherein the one or more speech features may optionally comprise a pitch frequency of a speech signal derived from the some or all of the plurality of microphone-signals.

In one or more embodiments, the beam-selection-controller may be configured to provide a control-signal such that the output-module is configured to select at least two different beamformer output signals that are associated with beamforming-modules that are focused in different fixed directions.

In one or more embodiments, the speech-leakage-estimation-modules may be configured to determine the similarity measure in accordance with at least one of: a statistical dependence of the received speech-reference-signal with respect to the received noise-reference-signal; a correlation of the received speech-reference-signal and the received noise-reference-signal; a mutual information of the received speech-reference-signal and the received noise-reference-signal; and an error signal provided by adaptive filtering of the received speech-reference-signal and the received noise-reference-signal.

In one or more embodiments, the speech-leakage-estimation-modules may be configured to determine the similarity measure in accordance with: an error-power-signal representative of a power of the error signal; and a noise-reference-power-signal representative of a power of the noise-reference-signal.

In one or more embodiments, the speech-leakage-estimation-modules may be configured to: determine a selected subset of frequency bins based on a pitch-estimate representative of a pitch of a speech-component of the plurality of microphone-signals; and determine the error-power-signal and the noise-reference-power-signal based on the selected subset of frequency bins.

In one or more embodiments, the signal processor may further comprise a pre-processing block configured to receive and process the plurality of microphone-signals to provide the input-signalling by one or more of: performing echo-cancellation on one or more of the plurality of microphone-signals; performing interference cancellation on one or more of the plurality of microphone-signals; and performing frequency transformation on one or more of the plurality of microphone-signals.

In one or more embodiments, the plurality of beamforming-modules may each comprise a noise-canceller block configured to: adaptively filter the respective noise-reference-signal to provide a respective filtered-noise-signal; and subtract the filtered-noise-signal from the respective speech-reference-signal to provide the respective beamformer output signal.

In one or more embodiments, the output-module is configured to provide the output-signal as a linear combination of the selected plurality of beamformer output signals.

In one or more embodiments, there may be provided a computer program, which when run on a computer, may cause the computer to configure any signal processor of the present disclosure.

In one or more embodiments, there may be provided an integrated circuit or an electronic device comprising any signal processor of the present disclosure.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

The above discussion is not intended to represent every example embodiment or every implementation within the scope of the current or future Claim sets. The figures and Detailed Description that follow also exemplify various example embodiments. Various example embodiments may be more completely understood in consideration of the following Detailed Description in connection with the accompanying Drawings.

BRIEF DESCRIPTION OF DRAWINGS

One or more embodiments will now be described by way of example only with reference to the accompanying drawings in which.

In the context of speech enhancement, multi-microphone acoustic beamforming systems can be used for performing interference cancellation, by exploiting spatial information of a desired speech signal and an undesired interference signal. These acoustic beamforming systems can process multiple microphone signals to form a single output signal, with the aim of achieving spatial directionality towards a desired speech direction. When the desired speech impinges on a microphone array from a different direction than an interference signal(s), this spatial directionality can lead to an improved speech-to-interference (SIR) ratio. In case the desired speech direction is static and known, a fixed beamforming system can be used where the beamformer filters are designed a priori using any state-of-the-art technique. In case the desired speech direction is unknown and changing over time, an adaptive beamforming system can be used, in which filter coefficients are changed regularly during operation to adapt to the evolving acoustic situation.

Figure 1:
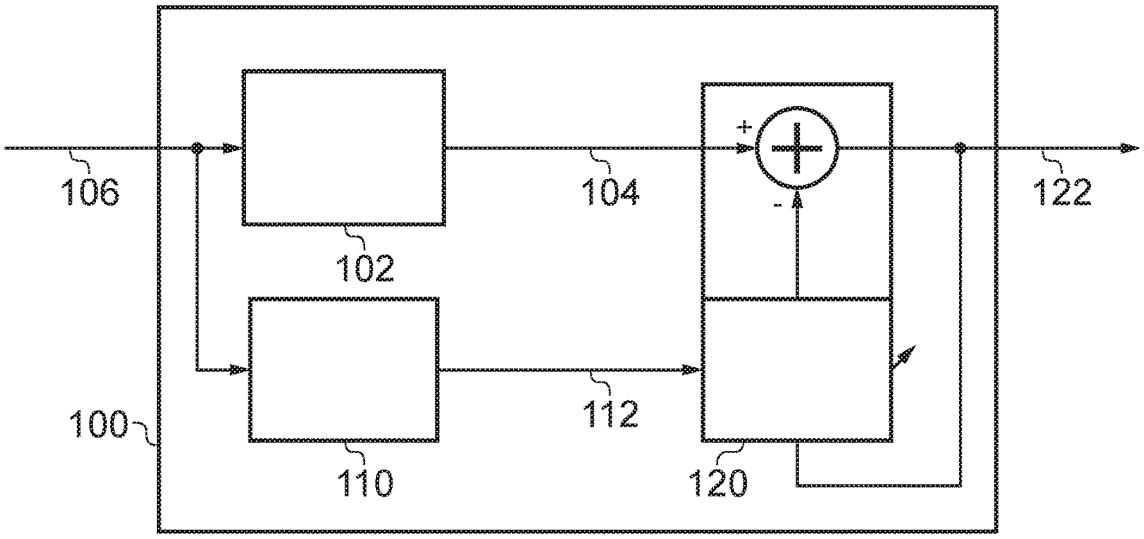
FIG. 1 shows an example of a generalized sidelobe canceller.

FIG. 1 shows an efficient adaptive beamforming structure which is a generalized sidelobe canceller 100 (GSC). The GSC 100 structure has three functional blocks. First, a constructive beamformer 102 is directional towards a speech source direction and thereby creates a speech reference signal 104 as an output, based on a plurality of microphone signals 106 that are received as inputs to the constructive beamformer 102. A blocking matrix 110, which also receives the microphone signals 106, creates one or multiple noise reference signals 112 by cancelling signals from the desired speech direction. Finally, in a noise canceller 120 the noise reference signals 112 are adaptively cancelled from the speech reference signal 104, resulting in a GSC beamformer output signal 122, which is a noise cancelled representation of one or more of the original microphone signals 106. The noise canceller 120 can use filter coefficients to filter the noise reference signal 112, and these filter coefficients can be adapted using the GSC output signal 122 as feedback.

For the challenging scenario of an unknown and dynamic desired speech source direction, a possible solution within the GSC 100 structure is to make the beamformer 102 and blocking matrix 110 blocks adaptive. This means their filter coefficients can be adapted over time such that the directionality of the beamformer 102 is aimed towards the correct desired talker direction, and the blocking matrix 110 blocks out contributions from this desired direction. This approach can result in several disadvantages, as described below:

- Cancellation of desired speech: an adaptive beamformer can suffer from erroneous adaptation of the filter coefficients due to, for example, a failing voice-activity detector, improper adaptation of parameters, or non-ideal microphone characteristics amongst other reasons. This can lead to focusing a beam in an incorrect direction; that is a direction that is not towards the origin of the speech. The noise reference signal 112, computed by steering a null into this wrongly estimated desired speech direction, then contains significant levels of the desired speech signal, a phenomenon termed speech leakage. In the noise canceller 120 stage, this noise reference signal 112, which includes the leaked speech, is cancelled from the speech reference signal 104, resulting in cancellation of the desired speech.
- Insufficient tracking speed: when the direction of the desired speech source changes, an adaptive beamformer can re-adapt to track the change of direction and refocus a beam into the new desired direction. This re-adaptation inherently takes time and can result in an insufficient tracking speed in highly dynamic scenarios, with insufficient SIR gains during the transition periods.
- Lack of robustness to challenging interference conditions: the previous two problems are emphasized in the presence of interferences exhibiting a low SIR at the microphones. This means that GSC beamforming systems can perform inadequately in challenging interference conditions.

Figure 2:
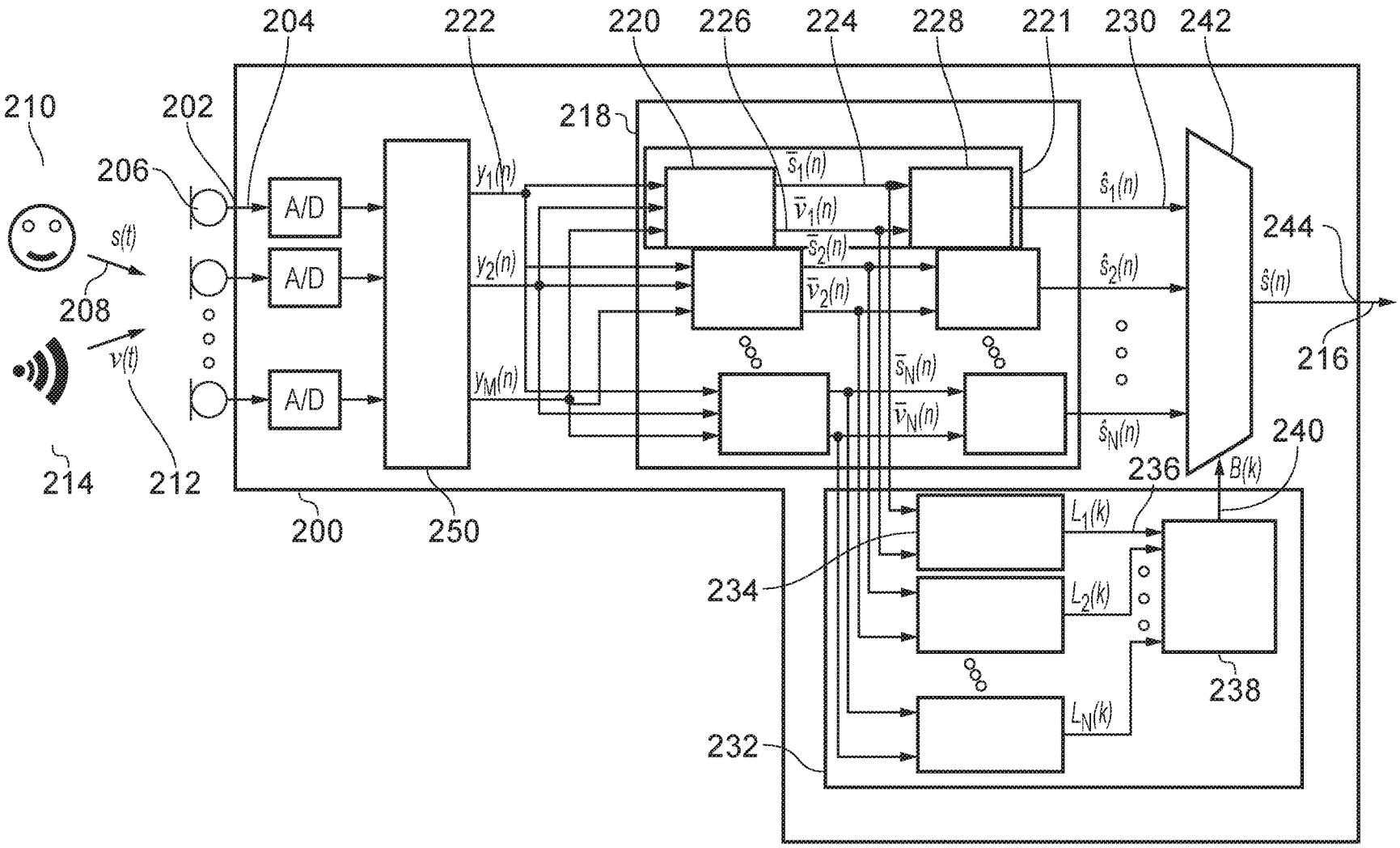
FIG. 2 shows an example embodiment of a signal processor.

FIG. 2 shows an example embodiment of a signal processor 200 that can address one or more of the above disadvantages. The signal processor 200 includes a beamforming-block 218 that includes a plurality (N) of parallel fixed beamforming-modules 221. Each fixed beamforming-module 221 receives input-signalling 222, representative of microphone signals from a plurality of microphones 206, and focuses a beam into a different and time-invariant angular direction from which the microphone signals are received. Together, the beamforming-modules 221 span the full desired angular reach, and each provide: (i) a speech-reference-signal 224 $\bar{s}_i(n)$; (ii) a noise reference signal 226 $\bar{v}_i(n)$; (iii) and a noise-cancelled beamformer output signal 230 $\hat{s}_i(n)$.

The signal processor 200 also includes a beam-selection-module 232 for providing a control signal 240 B(k). The control signal 240 B(k) is based on an amount of speech leakage that is determined to be associated with each of the associated beamforming modules, and is used to select which of the noise-cancelled beamformer output signals 230 $\hat{s}_i(n)$ is/are provided as an output signal 216 $\hat{s}(n)$ of the signal processor 200. For instance, the noise-cancelled beamformer output signal 230 $\hat{s}_i(n)$ that has the lowest speech leakage can be provided as the output signal 216 $\hat{s}(n)$.

In this way, the signal processor 200 can execute a speech leakage-based beam selection method. The method can be designed to dynamically select the best beamformer output, which can be the beamformer output signal for which the beam focuses optimally, or as optimally as possible, towards the desired speech direction. The method can thereby select one or more of the fixed beam directions for which the noise reference has a minimum or acceptable speech leakage feature, with respect to some, or all, of the N beams processed by the signal processor 200. When a beam is focused into the desired speech direction, the speech leakage into the noise reference signal is expected to be low. Conversely, for a beam focusing into an undesired direction, the speech leakage into a noise reference signal is expected to be high.

The signal processor 200 has a plurality of microphone-terminals 202 configured to receive a respective plurality of microphone-signals 204. In this example only a first microphone terminal 202 is provided with a reference numeral, along with other components and signals in a first signal path. However, it will be appreciated that signal processors of the present disclosure may have any number of signal paths with similar functionality.

The microphone signals 204 can be representative of audio signals received at a plurality of microphones 206. The audio signals can include a speech component 208 from a talker 210 and a noise component 212 from an interference source 214. The speech component 208 and the noise component 212 can originate from different locations and therefore arrive at the plurality of microphones 206 at different times. As is known in the art, when beamforming processing is performed on the plurality of microphone signals 204, audio signals received from a beam-focussed direction are combined constructively, and audio signals received from other directions are destructively combined.

The beamforming-block 218 includes a plurality of beamforming-modules, including a first beamforming-module 221. Each beamforming-module is configured to receive and process input-signalling 222 representative of some or all of the plurality of microphone-signals 204 to provide a respective speech-reference-signal 224 $\bar{s}_i(n)$, and a respective noise-reference-signal 226 $\hat{v}_i(n)$, based on focusing a beam into a respective angular direction. Each beamforming-module 220 may process input signalling representative of each of the plurality of microphone signals 204, or only a selected subset of the plurality of microphone signals 204 that are available.

Each of the plurality of beamforming-modules 221 in this example includes a fixed beamformer 220, coupled to an adaptive noise-canceller block 228. Each fixed to beamformer 220 receives the input-signalling 222, representative of the plurality of microphone signals as input signalling, and provides a speech reference signal 224 $\bar{s}_i(n)$ and a noise reference signal 226 $\bar{v}_i(n)$ as output signalling. Each fixed beamformer 220 can include a constructive beamformer and a blocking matrix, similar to the beamformer and blocking matrix discussed above in relation to FIG. 1. Each speech reference signal 224 $\bar{s}_i(n)$ can be computed by focusing a beam into a respective fixed angular direction, and each noise reference signal 226 $\bar{v}_i(n)$ can be computed by steering a null into the same respective angular direction. In this way, each fixed beamformer 220 has a predetermined, fixed, beam direction. An example implementation of a fixed beamformer 220 will be described below with reference to FIG. 3.

In each respective noise-canceller block 228, the respective noise-reference-signal 226 $\bar{v}_i(n)$ is adaptively cancelled from the respective speech-reference-signal 224 $\bar{s}_i(n)$, to provide respective beamformer output signals 230 $\hat{s}_i(n)$, which can collectively be described as beamformer-signalling. There is no specific requirement for the filter structure or design procedure for either the fixed beamformers 220 or the adaptive noise cancellers 228. As discussed above, each of the fixed beamformers 220 can steer a constructive beam in a respective desired angular direction, while the associated adaptive noise canceller 228 can cancel contributions from the desired angular direction. An example implementation of a noise-canceller block 228 will be described below with reference to FIG. 4.

The beam-selection-module 232 comprises a plurality of speech-leakage-estimation-modules 234, one for each of the beamforming-modules 221. Each respective speech-leakage-estimation-module 234 is configured to receive a speech-reference-signal 224 $\hat{s}_i(n)$ and an associated noise-reference-signal 226 $\bar{v}_i(n)$ from a respective one of the plurality of beamforming-modules 221, and provide a speech-leakage-estimation-signal 236 $L_i(k)$ based on a similarity measure of the respective speech-reference-signal 224 with respect to the respective noise-reference-signal 226 $\bar{v}_i(n)$. An example of a similarity measure between two signal can be any form of statistical dependence between the two respective signals.

The speech-leakage-estimation-modules 234 are each configured to execute a speech leakage estimation method: that is, a method to estimate the amount of speech leakage in each noise reference signal 226 $\bar{v}_i(n)$. In some examples, the method can operate by determining a speech leakage feature ($L_N(k)$) for short time frames k, based on both the noise reference signal 226 $\bar{v}_i(n)$ and the speech reference signal 224 $\bar{s}_i(n)$ In such cases, the plurality of microphone signals 202 that are processed for determining the speech leakage feature ($L_N(k)$) each correspond to a short portion or frame of an audio signal. The speech leakage feature ($L_N(k)$) is a measure of the statistical dependence between each respective noise reference signal 226 $\bar{v}_i(n)$ and the associated speech reference signal 224 $\bar{s}_i(n)$, as discussed further below in relation to FIG. 5.

The beam-selection-module 232 also has a beam-selection-controller 238 configured to provide a control-signal 240 B(k) based on the speech-leakage-estimation-signals 236 $L_i(k)$. As will be discussed below, the control-signal 240 B(k) is used to select which of the noise-cancelled beamformer output signals 230 $\hat{s}_i(n)$ is/are provided as an output signal 216 $\bar{s}(n)$ of the signal processor 200.

The signal processor 200 also has an output-module 242, associated with an output-terminal 244 of the signal processor 200 for providing the output signal 216 $\hat{s}(n)$. The output-module 242 receives the beamformer output signals 230 $\hat{s}_i(n)$, each of which is representative of a respective speech-reference-signal 224 $\bar{s}_i(n)$. The output-module 242 also receives the control-signal 240 B(k) from the beam-selection-controller 238. The output-module 242 selects which one or more of the beamformer output signals 230 $\hat{s}_i(n)$ to provide as the output-signal 216 $\hat{s}(n)$, in accordance with the control-signal 240 B(k). In this way, the output-signal 216 $\hat{s}(n)$ is based on at least one of the speech-reference-signals 224 $\bar{s}_i(n)$, and one of the noise reference signals 226 $\bar{v}_i(n)$, selected based on the control-signal 240 B(k).

In the example of FIG. 2, the output-module 242 includes a multiplexer which is configured, by the control signal 240 B(k), to select a single one of the beamformer output signals 230 $\hat{s}_i(n)$, and to provide the selected beamformer output signal $\hat{s}_i(n)$ to the output-terminal 244 as the output signal 216 $\hat{s}(n)$. Alternatively, in other examples, the output-module 242 can be configured to select multiple beamformer output signals and optionally to provide a linear combination of the selected signals to the output-terminal 244, for example according to a minimum speech leakage criterion per frequency sub-band, as discussed further below.

The signal processor 200 in this example also contains an optional pre-processing block 250 that is configured to apply pre-processing to the plurality of microphone signals 204 to provide the input-signalling 222 for the beamforming-block 218.

Pre-processing can provide certain advantages to enable improved performance in certain situations. For example, pre-processing can include performing echo cancellation on one or more of the microphone signals 204 in cases where one or several dominant echo interference sources may exist. This can reduce the possibility that the speech leakage feature 236 ($L_i(k)$) could be polluted by the dominant echo source(s). In another example, pre-processing can include performing a frequency sub-band transformation of one or more of the microphone signals 204. In such cases the subsequent beamformer operations can be performed in a particular frequency sub-band, as further described below.

In some examples, one or more of the plurality of speech-leakage-estimation-modules 234 can include a frequency-selection-block (not shown). Here, the frequency-selection-block can receive one or both of the speech reference signal 224 $\bar{s}_i(n)$ and the noise reference signal 226 $\bar{v}_i(n)$. The frequency-selection-block can select one or more frequency bins from the speech reference signal 224 $\bar{s}_i(n)$ and/or the noise reference signal 226 $\bar{v}_i(n)$. in order to generate the speech-leakage-estimation-signal 236. The selection can be based on a one or more speech features. For example, a speech feature can be a pitch frequency of a speech signal present in the plurality of microphone signals 204. The pitch signal can be the fundamental frequency of the speech signal, in which case the selection of frequency bins may include those frequency bins that contain the fundamental frequency and higher harmonics of the speech signal. Thereby, the speech-leakage-estimation-signal 236 may advantageously not include frequency bins that do not contain components of the speech signal, but that do contain unwanted noise or interference in frequency bins between the harmonics of the speech signal. In some examples, the frequency-selection-block may provide the speech-leakage-estimation-signal 236 such that two or more different speech signals associated with different speakers are processed separately.

In some examples, the signal processor 200 may provide the output-signal 216 such that it contains a first-speech-signal and a second-speech-signal. In some examples the output-signal 216 may be a linear combination of the first-speech-signal and the second-speech-signal. The first-speech-signal can be based on a first-frequency-sub-band-signal representative of a first filtered representation of the input-signalling, the first filtered representation spanning a first frequency range. The second-speech-signal can be based on a second-frequency-sub-band-signal representative of a second filtered representation of the input-signalling, the second filtered representation spanning a second frequency range. The first and/or second filtered representations can be provided by optional bandpass filter blocks (not shown).

The first frequency range can be different than the second frequency range. In such examples, the first frequency range can be chosen to match a frequency range of a first talker, while the second frequency range can be chosen to match frequency range of a second talker. It will be appreciated that the first and second frequency ranges may be different but still overlap each other. In this way, it can be possible to track changes in the angular direction of the first and second talkers independently. It can also be possible to provide the output signal 216 either as a single signal including a noise-cancelled version of both the first-speech-signal and the second-speech-signal, or the output signal 216 could be provided as two sub-output-signals, a first sub-output-signal, representative of the first-speech-signal, provided to a first sub-output terminal and a second sub-output-signal, representative of the second-speech-signal, provided to a second sub-output terminal.

The first-speech-signal can be based on a first speech-reference-signal and a first noise-reference-signal provided by a first beamforming-module focusing a beam into a first angular direction. The first beamforming-module can process the first-frequency-sub-band-signals. Similarly, the second-speech-signal can be based on a second speech-reference-signal and a second noise-reference-signal provided by a second beamforming-module focusing a beam into a second angular direction. The second beamforming-module can process the second-frequency-sub-band-signals. In such cases, the first angular direction may or may not be different than the second angular direction. In this way, the signal processor 200 can independently track speech signals from two different talkers, who may or may not be located in different positions, and provide a output signal that includes noise cancelled representations of both different speech signals. The output signal can be provided as either a single signal, or as multiple sub-signals as described above. It will be appreciated that tracking based on frequency band may be combined with tracking based on using different angular directions in the same signal processor. In some examples, the may be Na*Nf parallel beamforming modules, where Na is a number of angular directions and Nf is a number of frequency bands. Each beamforming module can operate on bandpass filtered signals (so that it is restricted to one of the frequency bands) and can focus a beam into a particular angular direction. For each frequency band, one or more beamformer output signals can be selected based on the Na sets of speech-reference and noise reference signals, for example.

Specific example embodiments of the present disclosure are presented in the following sections. Some of the embodiments are in relation to a set-up with two microphones. However, it will be appreciated that the following disclosures can also apply to examples comprising a plurality of microphones of any number greater than two. Further, the beamforming-modules disclosed below can be implemented as integer delay-and-sum beamformers (DSB), although it will be appreciated that any other type of beamformer could also be used.

Figure 3:
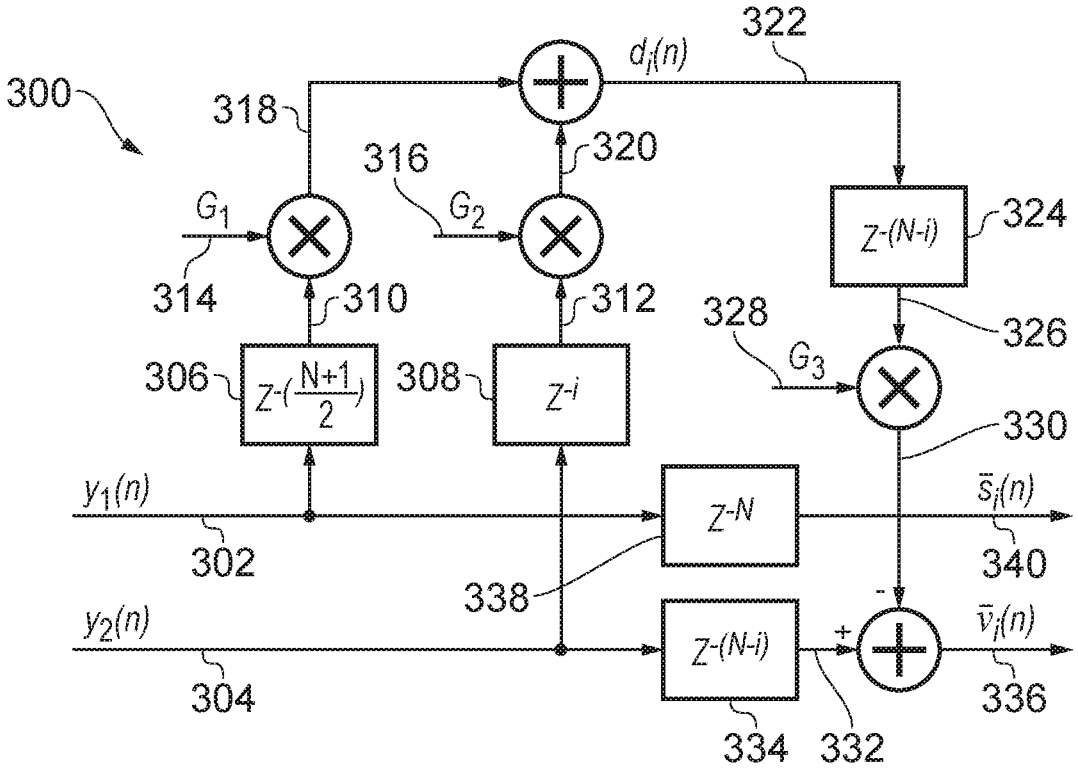
FIG. 3 shows an example embodiment of a beamforming module.

FIG. 3 shows a block diagram of a beamforming module 300. In this example, the beamforming module 300 is an integer DSB that illustrates DSB operation for a two-microphone case. The beamforming module 300 receives a first microphone signal 302 (denoted $y_1(n)$) and a second microphone signal 304 (denoted $y_2(n)$). A first delay block 306 receives the first microphone signal 302 and provides a first delayed signal 310. A second delay block 308 receives the second microphone signal 304 and provides a second delayed signal 312. The first delayed signal 310 is multiplied by a first factor 314 (denoted $G_1$) to provide a first multiplied signal 318. The second delayed signal 312 is multiplied by a second factor 316 (denoted $G_2$) to provide a second multiplied signal 320. The first multiplied signal 318 is combined with the second multiplied signal 320 to provide a speech estimate signal 322 (denoted $d_i(n)$). In this way, the two microphone signals 302, 304 are delayed and linearly combined to form the speech estimate signal 322 in accordance with the following equation:

$$d_i(n) = G_1 y_1\left(n - \frac{N+1}{2}\right) + G_2 y_2(n-i), \quad \text{for } i = 1, 2, \ldots, N$$

The beamforming module 300 can be part of a system of N distinct DSBs that span an integer delay range between both microphone signals ranging from −(N−1)/2 signal samples for the first DSB, to (N−1)/2 signal samples for the Nth DSB. In order to span sufficient angular directions, the number of DSBs can be chosen as according to the following equation:

$$N = 2\left\lceil \frac{D_{mic}}{c} fs \right\rceil + 1,$$

where $D_{mic}$ is the distance (in meters) between the two microphones, $f_s$ is a signal sampling frequency (in samples per second) and c is the speed of sound (in m/s). In some examples the DSBs need not necessarily be restricted to have integer sample delays, as is the present example. For example, when the inter-microphone distance $D_{mic}$ is small, it may be desirable to have more angular regions than would arise from integer delays.

In this example, the speech estimate signal 322 is provided to a third delay block 324 which provides a third delayed signal 326. The third delayed signal 326 is multiplied by a third factor 328 (denoted $G_3$) to provide a third multiplied signal 330. Then, the third multiplied signal is subtracted from a delayed representation 332 of the second microphone signal 304 (provided by a fourth delay block 334) to form the noise reference signal 336 (denoted $\bar{v}_i(n)$), as exemplified by the following equation:

$$\bar{v}_i(n) = y_2(n-N+i) - G_3 d_i(n-N+i), \text{ for } i=1,2, \ldots, N$$

A speech reference signal 340 (denoted $\bar{s}_i(n)$) is provided by a fifth delay block 338 which provides a delayed representation of the first microphone signal 302, to provide appropriate synchronization with respect to the noise reference signal 336, as illustrated in the following equation:

$$\bar{s}_i(n) = y_1(n-N), \text{ for } i=1,2, \ldots, N$$

Alternatively, in other examples (not shown) the speech reference signal could be set equal to the speech estimate signal, i.e.:

$$\bar{s}_i(n) = d_i(n), \text{ for } i=1,2, \ldots, N$$

In the general case of M microphones, a similar DSB structure can be provided (not shown), that can output only one speech reference signal (e.g. a delayed primary microphone signal) and one noise reference signal (e.g. by subtracting a speech estimate signal from any selected microphone signal, except the primary microphone signal).

Figure 4:
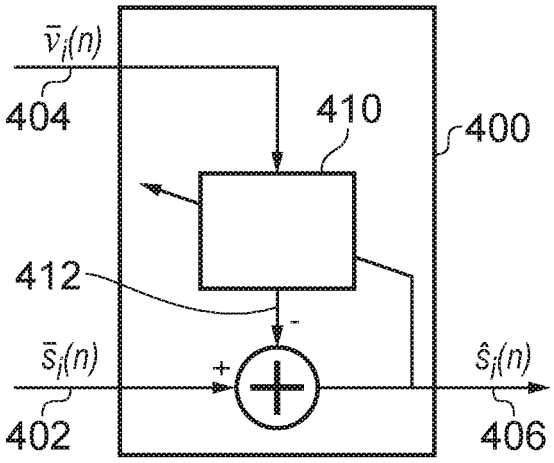
FIG. 4 shows an example embodiment of an adaptive noise canceller.

FIG. 4 shows an example of a noise-canceller block 400 similar to the noise-canceller blocks discussed above in relation to FIG. 2. The noise-canceller block 400 is configured to provide a beamformer output signal 406 based on filtering a speech-reference-signal 402 and/or a noise-reference-signal 404 that are provided by an associated beamforming module (not shown). The beamformer output signal 406 can thereby provide a noise cancelled representation of a plurality of microphone signals.

In this example, the noise-canceller block 400 includes an adaptive finite impulse response (FIR) filter between the speech reference signal 402 $\bar{s}_i(n)$ and the noise reference signal 404 $\bar{v}_i(n)$, that provides the beamformer output signal 406 $\hat{s}_i(n)$. An adaptive filter block 410 (which can be represented mathematically as $a_i=[a_i(\mathbf{0}), a_i(\mathbf{1}), \ldots, a_i(R-1)]$) has filter length R taps. Filter adaptation is performed using the Normalized Least Mean Squared (NLMS) update rule, such as:

$$a_i(n+1) = a_i(n) + \gamma_i(n)\frac{\hat{s}_i(n)\bar{v}_i(n)}{\bar{v}_i^T(n)\bar{v}_i(n)}$$

where the adaptation step size $y_i(n)$ is time-dependent and the error signal (which in this case is the beamformer output signal 406 $\hat{s}_i(n)$) is defined as $\hat{s}_i(n)=\bar{s}_i(n)-a_i^T(n)\bar{v}_i(n)$ and where $\bar{v}_i(n)=[\bar{v}_i(n), \bar{v}_i(n-1), \ldots, \bar{v}_i(n-R+1)]$ is the vector storing the most recent noise reference signal samples. In this way, the n-th beamformer output signal 406 is provided as feedback to the adaptive filter block 410, to adapt the filter coefficients. The adaptive filter block 410 then filters the next (n+1)-th noise-reference-signal to provide a filtered signal 412, which is combined with the next (n+1) speech-reference-signal to provide the next (n+1) beamformer output signal. It will be appreciated that other filter adaptation approaches known to persons skilled in the art can also be employed, and that the present disclosure is not limited to using NLMS approaches.

Figure 5:
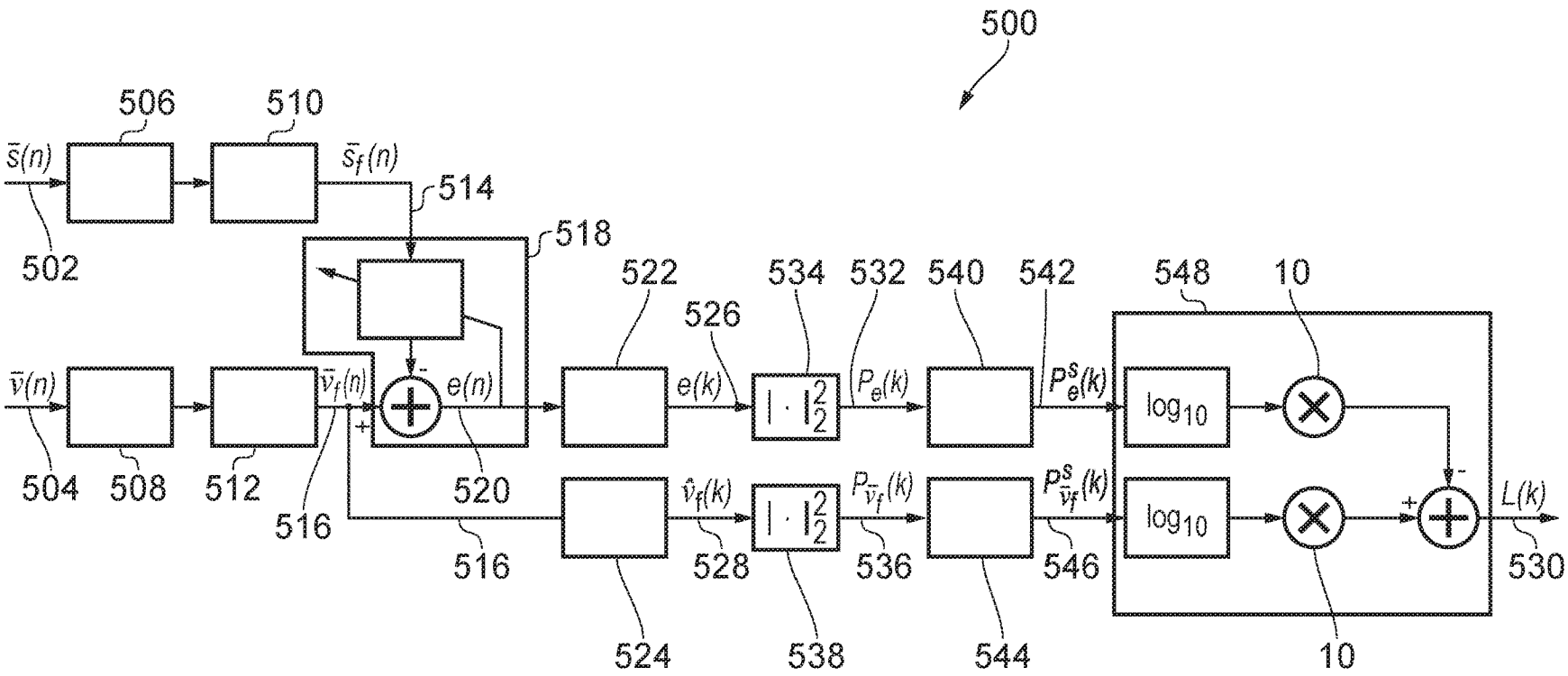
FIG. 5 shows an example embodiment of a speech leakage estimation module.

FIG. 5 shows different stages in an adaptive filter-based implementation of a speech-leakage-estimation-module 500 similar to those disclosed above in relation to FIG. 2. The speech-leakage-estimation-module 500 is configured to receive a speech-reference-signal 502 $\bar{s}(n)$ and a noise-reference-signal 504 $\bar{v}(n)$.

The amount of speech leakage in the noise-reference signal 504 can be estimated by assessing the level of statistical dependence between the noise reference signal 504 $\bar{v}(n)$ and the speech reference signal 502 $\bar{s}_i(n)$. Possible methods for assessing the level of statistical dependence can be based on running an adaptive filter between the speech reference signal 502 $\bar{s}_i(n)$ and the noise reference signal 504 $\bar{v}(n)$ and by measuring the amount of cancellation, or by obtaining a measure of the correlation between both signals 502, 504, or by obtaining a measure of the mutual information between both signals 502, 504, by way of example.

In a first stage, the speech reference signal 502 $\bar{s}(n)$ and the noise reference signal 504 $\bar{v}(n)$ are successively filtered by a high-pass filter 506, 508 (HPF) and a low-pass filter 510, 512 (LPF), which is effectively the same as applying a bandpass filter to the signals. This generates a filtered speech signal 514 $\bar{s}_f(n)$ and a filtered noise signal 516 $\bar{v}_f(n)$ This bandpass filtering can be advantageous in finding correlations in the relevant frequency band where speech signals can be dominant.

In a second stage, the filtered speech signal 514 $\bar{s}_f(n)$ and the filtered noise signal 516 $\bar{v}_f(n)$ are provided to an adaptive FIR filter 518 (which can be represented mathematically as h=[h(0), h(1), . . . , h(Q−1)]) with filter length Q taps. Filter adaptation is performed using a NLMS update rule, such as:

$$h(n+1) = h(n) + \mu \frac{e(n)\bar{s}_f(n)}{\bar{s}_f^T(n)\bar{s}_f(n)}$$

where μ is the adaptation step size, and an error signal 520 $e(n)$ is defined as:

$$e(n)=\bar{v}_f(n)-h^T(n)\bar{s}_f(n)$$

where $\bar{s}_f(n)=[\bar{s}_f(n), \bar{s}_f(n-1), \ldots, \bar{s}_f(n-Q+1)]$ is the vector storing the most recent speech reference signal samples.

In a third stage, the filtered noise signal 516 $\bar{v}_f(n)$ and the error signal 520 $e(n)$ are split into non-overlapping short-time frames by an error-frame block 522 and a noise-frame block 524, respectively, to provide an error vector 526 $e(k)$ and a noise vector 528 $\bar{v}_f(k)$, where k is a frame index. In this way, the subsequent processing by the speech-leakage-estimation-module 500 is performed for information received during specific time frames. The speech-leakage-estimation-module 500 estimates a speech leakage feature 530 L(k) in the noise reference signal 504 $\bar{v}(n)$ for each short-time frame. This can ultimately enable the beam selection module to provide a control signal for selecting a beamforming output signal as the output of the signal processor based only on recently received microphone signals (microphone signals received during the immediately preceding time frame (k), or time frames (k−1, . . . )). For the sake of improved clarity, the beam index i is dropped in the description below.

For each short-time frame, an error-power-signal 532 $P_e(k)$ representative of a power of the error vector 526 is computed by an error-power-block 534 in accordance with the following equation:

$$P_e(k)=\|e(k)\|_2^2$$

Similarly, for each short-time frame, a noise-reference-power-signal 536 $P_{vf}(k)$ representative of a power of the noise vector 528 is computed by a noise-power-block 538 in accordance with the following equation:

$$P_{\bar{v}_f}(k)=\|\bar{v}_f(k)\|_2^2$$

The error-power-signal 532 $P_e(k)$ and the noise-reference-power-signal 536 $P_{vf}(k)$ are examples of frame signal powers. In different examples, different variants of the above frame signal power computation can be applied. For example, the error-power-signal 532 $P_e(k)$ and/or the noise-reference-power-signal 536 $P_{vf}(k)$ may be computed in the frequency domain, retaining only a particular selected subset of frequency bins in the power computation. This frequency bin selection can be based on a speech activity detection. Alternatively, the frequency bin selection can be based on a pitch estimate representative of a pitch of a speech-component of the plurality of microphone-signals, where only powers at pitch harmonic frequencies are selected.

In a fourth stage, the frame signal powers are aggregated over a longer time period to obtain more robust power estimates. In this example, an error-sum block 540 aggregates a plurality of error-power-signals to provide an aggregate error signal 542 $P_e^s(k)$, and a noise-sum-block 544 aggregates a plurality of noise-reference-power-signals to provide an aggregate noise signal 546 $P_{\bar{v}_f}^s(k)$. A possible implementation is based on a sliding window aggregation, where the signal powers of the U most recent short-time frames are summed, for example according to the following equations:

$$P_e^s(k) = \sum_{i=0}^{U-1} P_e(k-i)$$

$$P_{\bar{v}_f}^s(k) = \sum_{i=0}^{U-1} P_{\bar{v}_f}(k-i)$$

Alternatively, recursive filters may be used to update the aggregated signal powers for each new short-time frame.

In a final stage 548, the speech leakage measure 530 L(k) is computed as a difference on a decibel (dB) scale between the aggregate error signal 542 $P_e^s(k)$ and the aggregate noise signal 546 $P_{\bar{v}_f}^s(k)$, for example, in accordance with the following equation:

$$L(k) = 10 \log_{10} \frac{P_{\bar{v}_f}^s(k)}{P_e^s(k)}$$

The speech leakage method as presented above is applied in a particular frequency band in this example, as both the speech reference signal 502 $\bar{s}(n)$ and the noise reference signal 504 $\bar{v}(n)$ are bandpass filtered prior to the adaptive filtering stage. It will be appreciated that this approach can be extended straightforwardly to a speech leakage estimation where multiple frequency bands are considered independently, and the speech leakage feature is computed—as per the above described method—for each of these frequency bands separately.

A control-signal, such at the control signal B(k) discussed above in relation to FIG. 2, can be provided based on a selected speech leakage measure, such as the speech leakage measure 530 L(k). The selected speech leakage measure can be selected based on determining a speech leakage measure with a minimum speech-leakage-estimation-power. In some examples, determination that a particular speech-leakage-estimation-power is a minimum may be determined by comparing each speech-leakage-estimation-power, relating to each speech leakage signal, and selecting the speech-leakage-estimation-power that has the smallest value. Such a minimum may be described as a global minimum speech-leakage-estimation-power. In other examples, each speech leakage measure that has a speech-leakage-estimation-power that satisfies a predetermined threshold, can be selected. Satisfying a predetermined threshold can mean that the speech-leakage-estimation-power is less than a predetermined value. Each such speech-leakage-estimation-power can be described as a minimum speech-leakage-estimation-power, and specifically as a local minimum speech-leakage-estimation-power. Different local minimum speech-leakage-estimation-powers can correspond to speech signals from different talkers, either positioned in different angular directions or talking in different frequency bands because the different talkers have voices in different pitch registers. In this way, signal processors of the present disclosure can track different talkers, in different frequency bands, or positioned in different angular directions.

Figure 6:
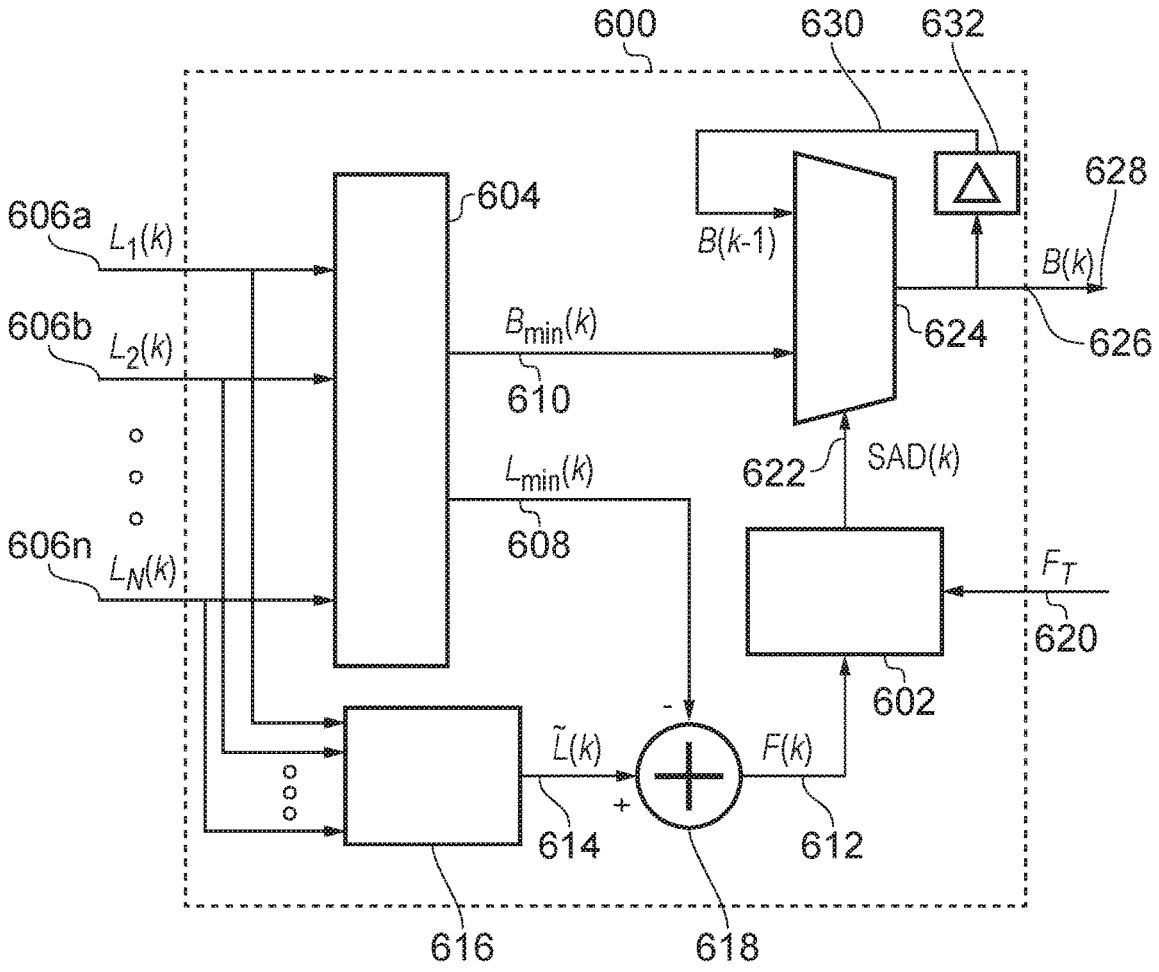
FIG. 6 shows an example embodiment of a beam selection module.

FIG. 6 shows a beam selection module 600 similar to the beam selection module disclosed above in relation to FIG. 2. The beam selection module 600 has a speech activity detector 602 that is configured to detect presence of a speech component in a plurality of microphone-signals (not shown), such as when the microphone signals contain speech signals from a talker.

As described in greater detail below, if a speech component is detected by the speech activity detector 602, then beamformer selection switching can be enabled. When beamformer selection switching is enabled, the beam selection module 600 can provide a control signal B(k) 628 that can select a different one or more of the beamformer modules (not shown) for providing the output signal of the signal processor. Conversely, if a speech component is not detected, the beam selection module 600 can provide a control signal B(k) 628 that disables beamformer selection switching. In this way, the output signal of the signal processor will be based on the beamformer output signal (or signals) from the same beamforming module (or modules) as for previous signal frames, such as an immediately preceding frame. That is, the beam selection module 600 may not change the control signal B(k) 628 if speech is not detected. If the beamformer signal switching is disabled, then a currently selected beamforming module can continue to be used, even if another of the beamforming modules has a lower speech-leakage-estimation-power.

Disabling beamformer signal switching can thereby act as an override that supersedes other mechanisms for selecting which beamformer output signal to provide as the output signal of the signal processor. The speech leakage feature $L_i(k)$ can therefore be beam-discriminative only during activity of the desired speaker. Hence, an optional part of the beam selection method is a desired speech activity detection governing whether the selected beam will be updated or not updated.

An outlier detection criterion of the speech leakage feature $L_i(k)$ over all beams can be used to enable the detection of desired speech. During speech activity, the speech leakage feature $L_i(k)$ for the beam (or beams) best corresponding to the talker direction should have low values; the speech leakage feature for the other beams should conversely have comparatively high values. The former beams will be 'outliers' when comparing all speech leakage features $L_i(k)$ over all beams. The detection of such outliers can be used as a method of detecting speech activity. During speech inactivity, there may be only environmental noise which typically may be more diffuse in nature, that is, originating more equally from all angular directions. The speech leakage feature $L_i(k)$ values can be similar for all beams, and there may be no outliers. A simple outlier detection rule, i.e. the difference between the mean and the minimum speech leakage feature values over all beams, can be used to detect speech activity or inactivity. Other outlier detection criteria could used, for example, based on determining a variance of speech leakage feature values. During desired speech activity, therefore, a beam which focuses into a direction close to the desired speech direction will exhibit low speech leakage in the noise reference signal, while the other beams, having a significant mismatch to the desired speech direction, will exhibit comparatively higher speech leakage in their respective noise reference signals.

In a first stage, in this example the beam selection module 600 includes a minimum block 604 that identifies the beam index ($B_{min}(k)$) for which the speech leakage measure $L_i(k)$ is lowest. The lowest speech leakage measure is denoted as $L_{min}(k)$. That is:

$$L_{min}(k) = \min_i L_i(k)$$

$$B_{min}(k) = \operatorname{argmin}_i L_i(k)$$

The minimum block 604 receives a plurality of speech leakage measure signals 606 $L_i(k)$. The minimum block 604 compares the plurality of speech leakage measure signals 606 $L_i(k)$ (one for each beamforming module) and selects the lowest to provide a minimum speech leakage measure signal 608 $L_{min}(k)$. The minimum block 604 also provides a k-th control signal 610 $B_{min}(k)$, which is representative of an index associated with the minimum speech leakage measure signal 608 $L_{min}(k)$. That is, the k-th control signal 610 $B_{min}(k)$ is indicative of which of the beamforming modules is providing a beamformer output signal that has the lowest speech leakage. When the k-th control signal 610 $B_{min}(k)$ is provided to an output-module (not shown), such as the output-module of FIG. 2, the k-th control signal 610 $B_{min}(k)$ enables the output-module to select the beamformer output signal associated with the minimum speech leakage measure signal 608 $L_{min}(k)$.

In a second stage, the beam selection module 600 performs desired speech activity detection. A feature signal 612 F(k) is computed as follows:

$$F(k)=\tilde{L}(k)-L_{min}(k)$$

where $\tilde{L}(k)$ 614 is a mean speech leakage measure 614 over all beams, i.e.

$$\tilde{L}(k) = \frac{1}{N}\sum_{i=1}^{N} L_i(k)$$

To perform the desired speech activity detection, the beam selection module 600 has a mean block 616 configured to receive the plurality of speech leakage measure signals 606 $L_i(k)$, and compute their mean value to provide the mean speech leakage measure 614 $\tilde{L}(k)$. The minimum speech leakage measure signal 608 $L_{min}(k)$ is then subtracted from the mean speech leakage measure 614 $\tilde{L}(k)$ by a subtractor block 618 to provided the feature signal 612 F(k). In this way, the feature signal 612 F(k) is representative of a difference between: (i) the mean value of the speech leakage measure signals 606 $L_i(k)$; and (ii) the lowest value of the speech leakage measure signals 608 $L_{min}(k)$.

The feature signal 612 F(k) is used by the speech activity detector 602 to perform a binary classification that provides a speech activity control signal 622 SAD(k) that is representative of either: desired speech activity, or no desired speech activity. The speech activity detector 602 compares the feature signal 612 F(k) to a predefined threshold signal 620 $F_T$, for example, according to the following equation:

$$SAD(k) = \begin{cases} 1, & F(k) \geq F_T \\ 0, & F(k) < F_T \end{cases}$$

Here, the speech activity control signal 622 SAD(k), has a value of 1 if a speech signal is detected, and has a value of 0 if no speech signal is detected. The speech activity control signal 622 SAD(k) is provided by the speech activity detector 602 to a control signal selector block 624. The control signal selector block 624 also receives the k-th control signal 610 $B_{min}(k)$.

In a third stage, the control signal selector block 624 performs beam selection for a current time frame, namely the k-th frame as it is described in this example, in order to provide the control signal 628 B(k). The control signal 628 B(k) will only be updated, such that the beam selection will only be updated towards the beam with minimum speech leakage, when the speech activity control signal 622 SAD(k) is representative of a detection of desired speech activity. If no speech activity is detected, then the control signal 628 B(k) is not changed, and the beam selection of the previous frame is retained for the current frame.

In this example, the control signal selector block 624 is a multiplexer, which provides the k-th control signal 610 $B_{min}(k)$ to an output terminal 626 of the beam selection module 600 when the speech activity control signal 622 SAD(k) indicates that speech is present. The output terminal 626 of the beam selection module 600 provides the control signal 628 B(k) to an output-module (not shown) as disclosed above in relation to FIG. 2.

Alternatively, when the speech activity control signal 622 indicates that speech is not present, the control signal selector block 624 provides a previous control signal 630 B(k−1) as the control signal 628 B(k). Mathematically, this can be expressed as:

$$B(k) = \begin{cases} B_{min}(k), & SAD(k) = 1 \\ B(k-1), & SAD(k) = 0 \end{cases}$$

The control signal 628 B(k) is stored in a memory/delay block 632, such that, as time passes, the previous control signal B(k−1) is provided at an output terminal of the memory/delay block 632. The output terminal of the memory/delay block 632 is connected to an input terminal of the control signal selector block 624. In this way, the previous control signal B(k−1) can be made available for passing to the output terminal of the control signal selector block 624.

Optionally, the speech activity detector 602 can be refined by combining the feature F(k) with another speech feature S(k), e.g. estimated with a state-of-the-art pitch estimation method or voicing estimation method. This allows for additional discrimination between a localised speech source (in which case both the features F(k) and S(k) would be high and trigger SAD(k)=1) and a localised non-speech source (in which case the sole feature F(k) could still be high and falsely trigger SAD (k)=1, but the speech feature S(k) would be low and prevent such false triggering).

In some examples, there can be a single desired speech direction at each time instant, and as such a single beam can be selected that focuses advantageously in this direction. It will be appreciated that the present disclosure also supports the case of multiple desired speech directions, as can happen in a conferencing application when different desired talkers present simultaneously. The extension to this case is straightforward. Selection of multiple beams can be achieved by selection of one beam for each different frequency band, according to a minimum speech leakage criterion in the particular frequency band.

Depending on the application, the beamformer-module output signals corresponding to the selected beams can be linearly combined to a single output signal, or each beamformer output signal can be streamed to the output separately (e.g. to enable speech separation).

Signal processors of the present disclosure can solve the problems of speech cancellation, low tracking speed and lack of robustness observed in GSC beamforming systems designed for interference cancellation, and to this end provide a speech leakage-driven switched beamformer system. The cancelled interference can be, for example, environmental noise, echo, or reverberation.

Signal processors of the present disclosure can operate according to a speech leakage based beam selection method, resulting in minimal/reduced speech cancellation and a fast tracking speed of directional changes of a desired talker. Signal processors of the present disclosure can also operate in accordance with a method for estimating the speech leakage in the noise reference signal.

Signal processors of the present disclosure can select one of the beamformer outputs at each point in time, and thereby present a speech leakage based beam selection method. Signal processors of the present disclosure do not require the angular direction of either the talker or the interference sources to be known.

Signal processors of the present disclosure provide a speech leakage based beam selection method, where both the speech reference and the noise reference of each beam can be used to determine the amount of speech leakage, and the beam selection criterion can be the minimum speech leakage. In case of a dominant speech source, other signal processors might select the beam showing significant suppression of the speech signal, resulting in speech cancellation. In contrast, signal processors of the present disclosure can select the beam with the minimum speech leakage, and thus the minimum speech cancellation. In case of a diffuse noise source, the beamformer output power will be more equal between the different directional beams, and the selection of the beamformer output with minimal energy may not necessarily offer the best speech-to-noise ratio improvement. In contrast, signal processors of the present disclosure can perform well in the presence of diffuse noise.

Signal processors of the present disclosure present a general system with N parallel delay-and-sum beamformers, which can be designed to cover a full angular reach. Moreover, the present solution can work with a generic beamformer unit that provides a speech reference signal and a noise reference signal.

Signal processors of the present disclosure can provide a generic multi-microphone beamformer interference cancellation system, where the interference could be any combination of individual noise, reverberation, or echo interference contributions.

Signal processors of the present disclosure can select one of the beamformer outputs at each point in time instant. This results in minimal speech cancellation and fast tracking to speeds for directional changes of the desired talker.

In some signal processors signal statistics on knowledge of the noise coherence matrix may be assumed to be time-invariant. In practice, these assumptions can be violated, reducing the performance of a designed blocking matrix. In contrast, the signal processors of the present disclosure may not rely on such assumptions and can be robust to changing speech and noise directions and statistics.

Signal processors of the present disclosure can overcome the disadvantages described previously by using multiple parallel GSC beamforming systems with fixed beamformer and blocking matrix blocks. Each of the fixed beamformers can focus a beam into a different angular direction. Signal processors of the present disclosure include a beam selection logic to switch dynamically and quickly to the beamformer which focuses towards the desired speech direction. Advantages of signal processors of the present disclosure can be at least threefold:

minimal cancellation of desired speech, faster tracking speed, robustness to challenging interference conditions.

Signal processors of the present disclosure can employ:

1. a novel speech-leakage estimation method based on two beamformer output signals, i.e. a speech reference signal and a noise reference signal;

2. a novel beam selection logic that uses the estimated speech leakage feature to dynamically select, among a fixed discrete set of N beamformers, the beamformer which focuses optimally towards the desired speech direction.

Signal processors of the present disclosure can be relevant to many multi-microphone speech enhancement and interference cancellation tasks, e.g. noise cancellation, dereverberation, echo cancellation and source localization. The possible applications of signal processors of the present disclosure include multi-microphone voice communication systems, front-ends for automatic speech recognition (ASR) systems, and hearing assistive devices.

Signal processors of the present disclosure can be used for improving human-to-machine interaction for mobile and smart home applications through noise reduction, echo cancellation and dereverberation.

Signal processors of the present disclosure can provide a multi-microphone interference cancellation system by dynamically focusing a beam towards the desired speech direction, driven by a speech leakage based feature. These methods can be applied for enhancing multi-microphone recordings of speech signals corrupted by one or multiple interference signals, such as ambient noise and/or loudspeaker echo. The core of the system is formed by a speech leakage based mechanism to dynamically select, among a fixed discrete set of beamformers, the beamformer which focuses best towards the desired speech direction, and thereby suppresses the interference signals from other directions.

Signal processors of the present disclosure can provide fast tracking of talker direction changes, i.e. showing no or very little speech attenuation in highly dynamic scenarios.

Discontinuities or fast changes in the desired talker and/or the interference signal levels or interference signal coloration which correspond with the time instants where the proposed invention switches beams according to the proposed minimum speech leakage feature can be effectively processed by signal processors of the present disclosure.

The instructions and/or flowchart steps in the above figures can be executed in any order, unless a specific order is explicitly stated. Also, those skilled in the art will recognize that while one example set of instructions/method has been discussed, the material in this specification can be combined in a variety of ways to yield other examples as well, and are to be understood within a context provided by this detailed description.

In some example embodiments the set of instructions/method steps described above are implemented as functional and software instructions embodied as a set of executable instructions which are effected on a computer or machine which is programmed with and controlled by said executable instructions. Such instructions are loaded for execution on a processor (such as one or more CPUs). The term processor includes microprocessors, microcontrollers, processor modules or subsystems (including one or more microprocessors or microcontrollers), or other control or computing devices. A processor can refer to a single component or to plural components.

In other examples, the set of instructions/methods illustrated herein and data and instructions associated therewith are stored in respective storage devices, which are implemented as one or more non-transient machine or computer-readable or computer-usable storage media or mediums. Such computer-readable or computer usable storage medium or media is (are) considered to be part of an article (or article of manufacture). An article or article of manufacture can refer to any manufactured single component or multiple components. The non-transient machine or computer usable media or mediums as defined herein excludes signals, but such media or mediums may be capable of receiving and processing information from signals and/or other transient mediums.

Example embodiments of the material discussed in this specification can be implemented in whole or in part through network, computer, or data based devices and/or services. These may include cloud, internet, intranet, mobile, desktop, processor, look-up table, microcontroller, consumer equipment, infrastructure, or other enabling devices and services. As may be used herein and in the claims, the following non-exclusive definitions are provided.

In one example, one or more instructions or steps discussed herein are automated. The terms automated or automatically (and like variations thereof) mean controlled operation of an apparatus, system, and/or process using computers and/or mechanical/electrical devices without the necessity of human intervention, observation, effort and/or decision.

It will be appreciated that any components said to be coupled may be coupled or connected either directly or indirectly. In the case of indirect coupling, additional components may be located between the two components that are said to be coupled.

In this specification, example embodiments have been presented in terms of a selected set of details. However, a person of ordinary skill in the art would understand that many other example embodiments may be practiced which include a different selected set of these details. It is intended that the following claims cover all possible example embodiments.

The invention claimed is:

1. A signal processor comprising:

a plurality of microphone-terminals configured to receive a respective plurality of microphone-signals;

a plurality of beamformers, each respective beamformer configured to receive and process input-signaling representative of some or all of the plurality of microphone-signals to provide a respective speech-reference-signal, a respective noise-reference-signal, and a beamformer output signal based on focusing a beam into a respective angular direction;

a filter comprising a plurality of adaptive filters, each respective adaptive filter configured to receive the speech-reference-signal and the noise-reference-signal from a respective one of the plurality of beamformers and provide a respective speech-leakage-estimation-signal based on a similarity measure of the received speech-reference-signal with respect to the received noise-reference-signal; wherein the filter further comprises a beam-selection-controller configured to provide a control-signal based on the speech-leakage-estimation-signals; and a multiplexer configured to: receive (i) a plurality of beamformer output signals from the beamforming modules and (ii) the control-signal, and select one or more, or a combination, of the plurality of beamformer output signals as an output-signal, in accordance with the control-signal.

2. The signal processor of claim 1, wherein each beamformers of the plurality of beamformers is configured to focus a beam into a fixed angular direction.

3. The signal processor of claim 1, wherein each beamformer of the plurality of beamformers is configured to focus a beam into a different angular direction.

4. The signal processor of claim 1, wherein each respective beamformer output signal comprises a noise-canceled representation of one or more, or a combination, of the plurality of microphone-signals.

5. The signal processor of claim 1, wherein each speech-leakage-estimation-signal is representative of speech-leakage-estimation-power, and the filter is configured to: determine a selected beamformer that is associated with the lowest speech-leakage-estimation-power; and provide a control-signal that is representative of the selected beamformer, such that the multiplexer is configured to select the beamformer output signal associated with the selected beamformer as the output-signal.

6. The signal processor of claim 1, wherein the beam-selection-controller is configured to receive a speech activity control signal; and after the speech activity control signal is representative of detected speech, then provide the control-signal based on most recently received speech-leakage-estimation-signals; and after the speech activity control signal is not representative of detected speech, then provide the control-signal based on previously received speech-leakage-estimation-signals.

7. The signal processor of claim 1, further comprising:

a frequency-selection-block configured to provide the speech-leakage-estimation-signal, by selecting one or more frequency bins representative of the some or all of the plurality of microphone-signals, the selection based on a pitch frequency of a speech signal derived from the some or all of the plurality of microphone-signals.

8. The signal processor of claim 1, wherein the beam-selection-controller is configured to provide a control-signal such that the multiplexer is configured to select at least two different beamformer output signals that are associated with beamformers that are focused in different fixed directions.

9. The signal processor of claim 1, wherein the adaptive filters are configured to determine the similarity measure in accordance with at least one of a statistical dependence of the received speech-reference-signal with respect to the received noise-reference-signal; a correlation of the received speech-reference-signal and the received noise-reference-signal; a mutual information of the received speech-reference-signal and the received noise-reference-signal; and an error signal provided by adaptive filtering of the received speech-reference-signal and the received noise-reference-signal.

10. The signal processor of claim 9, wherein the adaptive filters are configured to determine the similarity measure in accordance with an error-power-signal representative of a power of the error signal and a noise-reference-power-signal representative of a power of the noise-reference-signal.

11. The signal processor of claim 10, wherein the adaptive filters are configured to determine a selected subset of frequency bins based on a pitch-estimate representative of a pitch of a speech-component of the plurality of microphone-signals and determine the error-power-signal and the noise-reference-power-signal based on the selected subset of frequency bins.

12. The signal processor of claim 1, further comprising:

a pre-processing block configured to receive and process the plurality of microphone-signals to provide the input-signaling by one or more of performing echo-cancellation on one or more of the plurality of microphone-signals, performing interference cancellation on one or more of the plurality of microphone-signals, and performing frequency transformation on one or more of the plurality of microphone-signals.

13. The signal processor of claim 1, wherein each beamformer comprises:

a noise-canceller block configured to adaptively filter the respective noise-reference-signal to provide a respective filtered-noise-signal and subtract the filtered-noise-signal from the respective speech-reference-signal to provide the respective beamformer output signal.

14. The signal processor of claim 1, wherein the multiplexer is configured to provide the output-signal as a linear combination of the selected plurality of beamformer output signals.

15. An article of manufacture including at least one non-transitory, tangible, machine-readable storage medium containing machine-executable instructions, wherein the article of manufacture comprises:

instructions for receiving, with a plurality of microphone-terminals, a respective plurality of microphone-signals;

instructions for receiving and processing, with a plurality of beamformers, input-signaling representative of some or all of the plurality of microphone-signals to provide a respective speech-reference-signal, a respective noise-reference-signal, and a beamformer output signal based on focusing a beam into a respective angular direction;

instructions for receiving, with a respective adaptive filter, the speech-reference-signal and the noise-reference-signal from a respective one of the plurality of beamformers;

instructions for providing, with each respective adaptive filter, a respective speech-leakage-estimation-signal based on a similarity measure of the received speech-reference-signal with respect to the received noise-reference-signal;

instructions for providing, with a beam-selection-controller, a control-signal based on the speech-leakage-estimation-signals;

instructions for receiving, with a multiplexer, a plurality of beamformer output signals from the beamforming modules and the control-signal; and instructions for selecting, with the multiplexer, one or more, or a combination, of the plurality of beamformer output signals as an output-signal, in accordance with the control-signal.

* * * * *